US010952464B2

(12) United States Patent
Reed et al.

(10) Patent No.: US 10,952,464 B2
(45) Date of Patent: Mar. 23, 2021

(54) TOBACCO SMOKE FILTER

(75) Inventors: James D. Reed, Newcastle (GB); Roy Alingalan, Surabaya (ID)

(73) Assignee: Filtrona Filter Products Development Co. Pte. Ltd., Novena Square (SG)

( * ) Notice: Subject to any disclaimer, the term of this patent is extended or adjusted under 35 U.S.C. 154(b) by 1609 days.

(21) Appl. No.: 13/989,661

(22) PCT Filed: Nov. 24, 2011

(86) PCT No.: PCT/GB2011/001647
§ 371 (c)(1),
(2), (4) Date: May 24, 2013

(87) PCT Pub. No.: WO2012/069791
PCT Pub. Date: May 31, 2012

(65) Prior Publication Data

US 2013/0239984 A1 Sep. 19, 2013

Related U.S. Application Data

(60) Provisional application No. 61/458,582, filed on Nov. 26, 2010.

(30) Foreign Application Priority Data

Dec. 13, 2010 (GB) ..... 1021126

(51) Int. Cl.
*A24D 3/06* (2006.01)
*A24D 3/04* (2006.01)

(52) U.S. Cl.
CPC ..... *A24D 3/061* (2013.01); *A24D 3/048* (2013.01)

(58) Field of Classification Search
None
See application file for complete search history.

(56) References Cited

U.S. PATENT DOCUMENTS

| | | | | |
|---|---|---|---|---|
| 3,428,049 | A * | 2/1969 | Cogbill | A24D 3/061 131/337 |
| 4,281,671 | A | 8/1981 | Bynre et al. | |
| 2006/0174901 | A1 * | 8/2006 | Karles | A24D 3/163 131/337 |
| 2007/0074733 | A1 | 4/2007 | Rasouli et al. | |
| 2008/0302373 | A1 | 12/2008 | Stokes et al. | |
| 2009/0050163 | A1 | 2/2009 | Hartmann et al. | |

(Continued)

FOREIGN PATENT DOCUMENTS

| | | |
|---|---|---|
| DE | 10 2006 025 738 B3 | 11/2007 |
| GB | 1 095 848 | 12/1967 |

(Continued)

OTHER PUBLICATIONS

Search Report of Great Britain Patent Office issued in Great Britain Application No. 1021126.6 dated Mar. 31, 2011 (3 pages).

(Continued)

*Primary Examiner* — Phu H Nguyen
(74) *Attorney, Agent, or Firm* — Flynn Thiel, P.C.

(57) ABSTRACT

A tobacco smoke filter or filter element comprising: a rod (2) of a tobacco smoke filtering material; and an elongate member (3) including one or more frangible receptacles (5) integrally formed therein, the or each receptacle (s) including a fluid and being sealed by a capping member (7).

16 Claims, 1 Drawing Sheet

(56) References Cited

U.S. PATENT DOCUMENTS

| | | | | |
|---|---|---|---|---|
| 2009/0194118 | A1* | 8/2009 | Ademe | A24C 5/3412 131/346 |
| 2011/0232659 | A1 | 9/2011 | Ercelebi et al. | |

FOREIGN PATENT DOCUMENTS

| | | | |
|---|---|---|---|
| WO | WO 2006/082529 | A2 | 8/2006 |
| WO | WO 2010/003899 | A1 | 1/2010 |

OTHER PUBLICATIONS

PCT/ISA/210 dated Mar. 2, 2012 (5 pages).
PCT/ISA/220 dated Mar. 2, 2012 (1 page).
PCT/ISA/237 dated Mar. 2, 2012 (6 pages).

* cited by examiner

TOBACCO SMOKE FILTER

CROSS-REFERENCE TO RELATED APPLICATION

This application is the National Stage of International Application No. PCT/GB2011/001647, filed Nov. 24, 2011, which claims the benefit of U.S. Provisional Application No. 61/458 582, filed Nov. 26, 2010.

FIELD OF THE INVENTION

The present invention relates to tobacco smoke filters (e.g. for filter cigarettes) and their production. In particular, it relates to filters which include additive, for example a flavouring agent.

BACKGROUND OF THE INVENTION

Tobacco smoke filters which include a frangible capsule, or capsules, which contain an additive (e.g. a flavouring agent) are well known. The smoker applies pressure to the filter to break the capsule therein and thereby release the flavouring agent, immediately prior to smoking. However, such frangible capsules are fairly expensive to produce.

WO 2010/003899 discloses fluid-containing gelatin capsules coupled by an elongate connecting member. The capsules may be held in place on the elongate member by spot welding, extruded onto an elongate member in the form of a string, or the capsules and elongate member may be formed in a single extrusion process. The disclosed processes are complex, and require inclusion or production of a fluid containing capsule with its associated expense.

There is, therefore, a need for a cost-effective way of providing a frangible container (or containers) of (e.g. fluid, e.g. liquid) additive within a filter or filter element.

SUMMARY OF THE INVENTION

According to the present invention there is provided a tobacco smoke filter or filter element comprising: a rod (for example, a substantially cylindrical rod) of a tobacco smoke filtering material; and an elongate member including one or more frangible receptacles integrally formed therein, the or each receptacle(s) including a fluid and being sealed by a capping member. The receptacle(s) may be integrally formed with the elongate member such that the receptacle wails and base (floor) are formed integrally with the elongate member. The receptacle(s) may be hermetically sealed by the capping member(s). The receptacle(s) may be sealed by individual capping members (e.g. a separate capping member for each receptacle). In another example the elongate member may be substantially completely covered with an elongate capping member applied (e.g. fixed or held) in register with the elongate member to thereby cap the (or all) receptacle(s).

Preferably the elongate member and receptacles formed therein extend longitudinally of the tobacco smoke filter or filter element. The elongate member and receptacles formed therein may extend longitudinally of the filter or filter element along the central or substantially central longitudinal axis of the rod. The elongate member and receptacles formed therein may extend longitudinally of the filter or filter element along (at) the periphery of the rod.

The receptacle includes a fluid. Preferably, the fluid is a liquid. The fluid (e.g. liquid) may include a smoke enhancing additive, for example a flavouring agent. The flavouring agent may be any flavouring agent known or suitable for use in a smoking article such as a cigarette, for example menthol, spearmint etc. A preferred flavouring agent is menthol. Preferably the fluid (e.g. liquid) includes the additive, for example flavouring agent, together with a carrier material (for example a glycol, e.g. propylene glycol). Preferably the fluid (e.g. liquid) further includes a surfactant. The surfactant may lower the surface tension of the liquid, which may prevent "creep" of the liquid additive up the sides the receptacle. This may enhance loading of the receptacle and/or help prevent liquid "creep" from the receptacle when it is filled and sealed.

Preferably the sealed receptacle(s) which include fluid have a crush strength of 4 to 30 N, for example 5 to 25 N.

The elongate member having receptacles formed therein is preferably a single element e.g. formed as a single element by extrusion. The elongate member may be (formed from) a plastics material. The elongate member may be (formed from) a polymer, for example a natural polymer or a synthetic polymer. The elongate member may be (formed from) a mixture of polymers. The elongate member may be for example (formed from) cellulose acetate, polyethylene (PET), polypropylene, polylactide (PLA) a collagen, or mixtures of two or more of these materials. The elongate member may be made from a material which is approved for use in cigarette filters. The elongate member may be made from a material which melts or becomes pliable at the temperature of the filter during smoking (e.g. PLA). Melting etc of the material during smoking may enhance the release of the smoke enhancing additive (e.g. flavouring agent). Preferably the elongate member is not gelatin.

The (or each) capping member may be (formed from) a plastics material. The capping member(s) may be (formed from) a polymer, for example a natural polymer or a synthetic polymer. The capping member(s) may be (formed from) a mixture of polymers. The capping member(s) may be cellulose acetate, polyethylene (PET), polypropylene, polylactide (PLA), a collagen, or mixtures of two or more of these materials. The (or each) capping member may be made from a material which is approved for use in cigarette filters. The (or each) capping member may be made from a material which melts or becomes pliable at the temperature of the filter during smoking (e.g. PLA). Melting etc of the material during smoking may enhance the release of the smoke enhancing additive (e.g. flavouring agent). Preferably the capping member is not gelatin. The capping member(s) may be (formed from) a different material to the elongate member, or the same material.

The receptacles are (or each receptacle is) sealed (preferably hermetically) by a capping member or members. The receptacles may be sealed by conventional heat sealing, thermal impulse sealing, or ultrasonic sealing. In one example, for example when the elongate member and/or capping member are formed of cellulose acetate, the receptacles are sealed by heat sealing. In this example, the elongate member and/or capping member may include (have applied thereon) a heat seal coating which is activated (after the receptacles are filled) to form a bond between the elongate member and the capping member to effect the seal. The heat seal coating may be EVA (for example EVA supplied by Henkel), PVDA coating, vinyl acetate, or triethyl citrate. In a further example (e.g. when the elongate member and/or capping member are not formed of cellulose acetate), the receptacles may be sealed by ultrasonic sealing. This has the advantage of not requiring a heat seal coating. In a further example, the receptacles may be sealed mechanically, e.g. by crimping.

The invention provides in this aspect a tobacco smoke filter including one or more frangible, fluid containing, sealed receptacles formed integrally with an elongate member, which may represent a cost-effective alternative to capsules.

The receptacles may be any shape, for example hemispherical, cylindrical, trapezoidal, spherical, oval etc. Preferably the receptacle is an elongated cylindrical receptacle. The applicants have found that an elongate bubble (effectively pill shaped receptacle) may provide sufficient capsule capacity so the fluid additive delivers satisfactory flavour enhancement.

The tobacco smoke filter may be of length between 10 and 40 mm, e.g. between 15 and 35 mm, e.g. between 20 and 30 mm. The tobacco smoke filter element may be of length between 6 and 20 mm, e.g. between 10 and 19 mm, e.g. between 14 and 18 mm. The tobacco smoke filter or filter element may be of circumference between 16 and 38 mm, for example between 16 and 28 mm, for example between 20 and 26 mm. The (or each) receptacle(s) may be of length from 0.1 to 20 mm. Preferably, each receptacle is of length 0.5 to 15 mm, preferably 0.7 to 10 mm, more preferably of length 1 to 5 mm, most preferably of length from 1 to 3 mm. The (or each) receptacle may be of depth (e.g. depth at its deepest point) of 0.5 to 3.5 mm. The (or each) receptacle may be of width (e.g. width at its widest point) of 0.5 to 7 mm.

The tobacco smoke filtering material [e.g. included in, for example, forming, the rod (for example substantially cylindrical rod)] may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and synthetic non-wovens, and extruded material (e.g. starch, synthetic foams). The tobacco smoke filtering material (e.g. cellulose acetate filamentary tow) may further comprise a plasticiser (e.g. triacetin). The amount of plasticiser may be from 4 to 15% by weight of the filtering material.

The tobacco smoke filtering material may be over wrapped with a wrapper, for example a wrapper of paper, for example a wrapper of an air-permeable paper.

The elongate member (and/or capping member(s)) may be tinted using appropriate pigments, preferably those with regulatory approval for use in food contact applications. The pigment may preferably be any colour which contrasts with the (e.g. white) tobacco smoke filtering material, for example green, blue, red, orange etc. A coloured elongate member may provide a distinctive end appearance (e.g. mouth end appearance) in a final product filter or filter element (or filter cigarette) that is useful for anti-counterfeit purposes. The elongate member (and/or capping member(s)) may include a visual cue (e.g. be tinted using appropriate pigments, preferably those with regulatory approval for use in food contact applications) or other cue, which my be used to signify a characteristic (e.g. flavour) to the end user, or which may be used to assist in maintaining correct registration/positioning of the elongate member in the filter or filter element during manufacture.

The elongate member may comprise two or more frangible receptacles integrally formed therein, the receptacles being sealed by a capping member or capping members, wherein a first receptacle includes a first fluid and a second receptacle includes a second fluid, and first and second fluids being different fluids or fluids including different additives (e.g different flavouring agents). This example may provide a filter including two or more flavour receptacles along its length, each receptacle including a different flavour.

A filter according to the invention may be used on its own e.g. as a single segment filter. Such filters are well known in the art. A filter element according to the invention may be used as a segment, for example the mouth end segment, of a multi-segment filter, e.g. a dual, triple, other multiple filter. A filter element according to the invention may be used as another e.g. upstream segment, of a multi-segment filter—for example the tobacco end segment, middle segment etc. of a multi-segment filter, e.g. a dual, triple, other multiple filter. Multi-segment filters are well known in the art. The other elements of the multi-segment filter—e.g. those which are not according to the invention—may comprise activated carbon or other particulate additive(s). Filters according to the invention, or filters incorporating a filter element according to the invention, may be used (made, sold) as stand alone filters for later inclusion in a cigarette, for example for use by smokers who assemble their own cigarettes (that is as a Roll-your-own product).

In a filter cigarette according to the invention, a filter of the invention (or a filter which includes a filter element of the invention) is joined to a wrapped tobacco rod with one end towards the tobacco. The filter may, for example, be joined to the wrapped tobacco rod by ring tipping (which engages around just the adjacent ends of a [wrapped] filter and rod to leave much of the filter wrapper exposed) or by a full tipping overwrap (which engages around the full filter length and adjacent end of the tobacco rod). Any filter or filter cigarette according to the invention may be unventilated, or may be ventilated by methods well known in the art, e.g. by use of a pre-perforated or air-permeable plugwrap, and/or laser perforation of plugwrap and tipping overwrap.

The present invention also provides a filter cigarette which includes a tobacco smoke filter or filter element of the invention, as disclosed above.

The filters or filter elements according to the invention may be made as continuous rods, as is well known in the art. The continuous rod as it issues continuously from the production machine outlet is cut into finite lengths for subsequent use. This cutting may be into individual filters or filter elements as defined and described above, each of which is then attached to an individual wrapped tobacco rod to form a filter cigarette. More usually, however the continuously issuing rod is first cut into double or higher multiple (usually quadruple or sextuple) lengths for subsequent use; when the initial cut is into quadruple or higher lengths, then the latter are subsequently cut into double lengths for the filter cigarette assembly—in which the double length filter rod is assembled and joined (by ring tipping or full tipping overwrap) between a pair of wrapped tobacco rods with the combination then being severed centrally to give two individual filter cigarettes. The invention includes (e.g. double and higher) multiple length filter rods (and/or filter element rods), including a plurality of filter rods (filter element rods), e.g. joined end to end.

According to the present invention in a further aspect there is provided a first member (for example an elongate member) including one or more frangible receptacles integrally formed therein, the or each receptacle(s) including a fluid and being sealed by a capping member. The receptacle (s) may be integrally formed with the first member such that the receptacle walls and base (floor) are formed integrally with the first member. The receptacle(s) may be hermetically sealed by the capping member(s). The receptacle(s) may be sealed by individual capping members (e.g. a separate capping member for each receptacle). In another example the first member may be substantially completely covered with a capping member applied (e.g. fixed or held) in register with the (first) member to thereby cap the (or all) receptacle(s).

Preferably the first member and sealed receptacles formed therein are for use in a tobacco smoke filter or filter element.

The receptacle includes a fluid. Preferably, the fluid is a liquid. The fluid (e.g. liquid) may include a smoke enhancing additive, for example a flavouring agent. The flavouring agent may be any flavouring agent known or suitable for use in a smoking article such as a cigarette, for example menthol, spearmint etc. A preferred flavouring agent is menthol. Preferably the fluid (e.g. liquid) includes the additive, for example flavouring agent, together with a carrier material (for example a glycol, e.g. propylene glycol). Preferably the fluid (e.g. liquid) further includes a surfactant. Suitable surfactants such as e.g. Teepol are known. The surfactant may lower the surface tension of the liquid, which may prevent "creep" of the liquid additive up the sides the receptacle. This may enhance loading of the receptacle and/or help prevent liquid "creep" from the receptacle when it is filled and sealed.

Preferably the sealed receptacle(s) which include fluid have a crush strength of 4 to 30 N, for example 5 to 25 N.

The first member having receptacles formed therein is preferably a single element e.g. formed as a single element by extrusion. The first member may be (formed from) a plastics material. The first member may be for example (formed from) a polymer, for example a natural polymer or a synthetic polymer. The first member may be (formed from) a mixture of polymers. The first member may be for example (formed from) one or more of cellulose acetate, polyethylene (PET), polypropylene, polylactide (PLA), and a collagen. The first member may be made from a material which is approved for use in cigarette filters. The first member may be made from a material which melts or becomes pliable at the temperature of the filter during smoking (e.g. PLA). Melting etc of the material during smoking may enhance the release of the smoke enhancing additive (e.g. flavouring agent). Preferably the first member is not gelatin.

The (or each) capping member may be (formed from) a plastics material. The capping member(s) may be (formed from) a polymer, for example a natural polymer or a synthetic polymer. The capping member(s) may be (formed from) a mixture of polymers. The capping member(s) may be cellulose acetate, polyethylene (PET), polypropylene, polylactide (PLA) a collagen, or mixtures of two or more of these. The (or each) capping member may be made from a material which is approved for use in cigarette filters. The (or each) capping member may be made from a material which melts or becomes pliable at the temperature of the filter during smoking (e.g. PLA). Melting etc of the material during smoking may enhance the release of the smoke enhancing additive (e.g. flavouring agent). Preferably the capping member is not gelatin. The capping member(s) may be (formed from) a different material to the first member, or the same material as the first member.

The receptacles may be any shape, for example hemispherical, cylindrical, trapezoidal, spherical, oval etc. Preferably the receptacle is an elongated cylindrical receptacle. The applicants have found that an elongate bubble (effectively pill shaped receptacle) may provide sufficient capsule capacity so the fluid additive delivers satisfactory flavour enhancement.

The (or each) receptacle(s) may be of length from 0.1 to 20 mm. Preferably, each receptacle is of length 0.5 to 15 mm, preferably 0.7 to 10 mm, more preferably of length 1 to 5 mm, most preferably of length from 1 to 3 mm. The (or each) receptacle may be of depth (e.g. depth at its deepest point) of 0.5 to 3.5 mm. The (or each) receptacle may be of width (e.g. width at its widest point) of 0.5 to 7 mm.

The receptacles are (or each receptacle is) sealed (preferably hermetically) by a capping member or members. The receptacles may be sealed by conventional heat sealing, thermal impulse sealing, or ultrasonic sealing. In one example, for example when the first member and/or capping member are formed of cellulose acetate, the receptacles are sealed by heat sealing. In this example, the first member and/or capping member may include (have applied thereon) a heat seal coating which is activated (after the receptacles are filled) to form a bond between the elongate member and the capping member to effect the seal. The heat seal coating may be EVA (for example EVA supplied by Henkel), PVDA coating, vinyl acetate, or triethyl citrate. In a further example (e.g. when the first member and/or capping member are not formed of cellulose acetate), the receptacles may be sealed by ultrasonic sealing. This has the advantage of not requiring a heat seal coating. In a further example, the receptacles may be sealed mechanically, e.g. by crimping.

BRIEF DESCRIPTION OF THE DRAWINGS

The present invention will now be illustrated with reference to the attached drawings in which.

DETAILED DESCRIPTION

Figure 1:
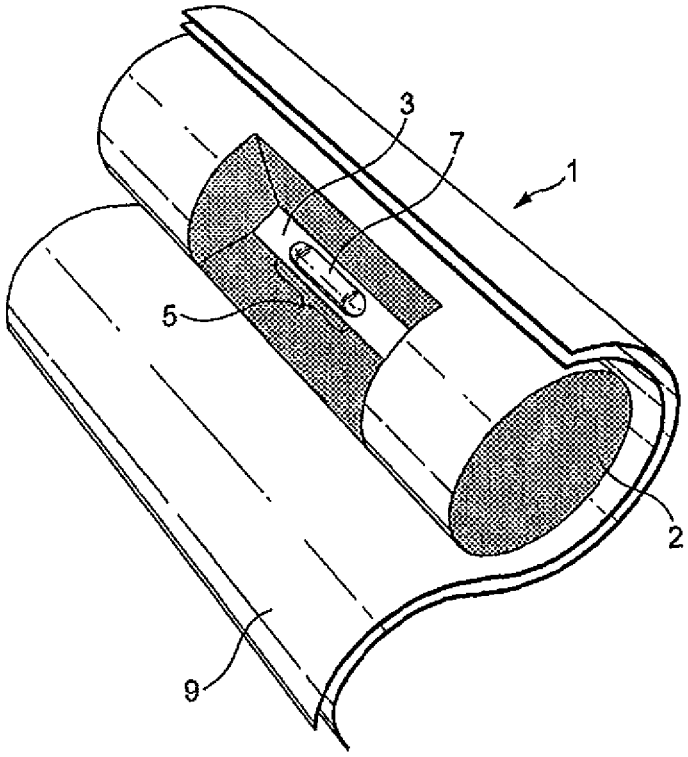
FIG. 1 is a perspective, part cut away, view of a tobacco smoke filter according to an aspect of the invention.

FIG. 1 is a perspective, part cut away, view of a filter 1. Filter 1 includes a substantially cylindrical rod 2 of tobacco smoke filtering material in the form of a cylindrical cellulose acetate plug of length 27 mm and circumference of around 25 mm. Filter 1 includes an elongate member 3 which is thermoformed from 4.5 mil Clarifoil cellulose acetate sheet.

Elongate member 3 includes an elongated receptacle 5 which is integrally formed therein, during the thermoforming process, by methods well known in the art. The elongate member (which includes the receptacle) extends longitudinally of filter 1. The elongated receptacle 5 includes 22 cubic mm of fluid (liquid) flavouring agent in the form of flavouring agent (menthol) and propylene glycol in a 70/30 ratio together with a surfactant such as Teepol (to reduce surface tension). Methods of introducing such fluids are known in the art. The elongate member is coated with an EVA heat seal coating (not shown). The receptacle is hermetically sealed with a capping member 7 formed from Clarifoil 3 mil cellulose acetate sheet, which is bonded to the elongate member by means of the heat seal coating to form a sealed frangible "bubble" including the liquid flavouring agent. The substantially cylindrical rod 2 is made from cellulose acetate tow which is gathered and condensed around elongate member 3 into rod form by methods which are well known in the art, see for example U.S. Pat. No. 4,281,671. It will be appreciated that rod 2 will be formed as a multiple length filter rod (by these known methods) and then cut into individual or multiple length filter rods for subsequent use. The elongate member (and/or capping member(s)) may be tinted using appropriate pigments, preferably those with regulatory approval for use in food contact applications. The pigment may preferably be any colour which contrasts with the (e.g. white) tobacco smoke filtering material, for example green, blue, red, orange etc. It will be appreciated that a coloured elongate member which contrasts with the surrounding filter material may well be visible at the cut end of the filter (rod) to thereby provide a distinctive end appearance. Such a distinctive e.g. mouth end appearance in a final product filter or filter element (or filter cigarette) may be useful for anti-counterfeit purposes.

The filter includes a wrapper 9 of an air-permeable paper, which applied around the rod 2 by methods well known in the art.

It will be appreciated that the filter of FIG. 1 may be joined at its upstream end to a wrapped tobacco rod (not shown) by means of, for example, a full tipping overwrap which surrounds and engages the full length of the filter 1 and the adjacent end only of the wrapped tobacco rod, to form a filter cigarette. The filter of FIG. 1 may also be attached to a tobacco rod to form a filter cigarette by other means known in the art, such as ring tipping.

It will be appreciated that filter and filter elements of the invention may include elongate members which include one or more sealed receptacles. In other examples (not shown) the elongate member included in the filter or filter element may include two, three, four, five to ten or even more sealed receptacles, depending on flavour loading requirements.

Figure 2:
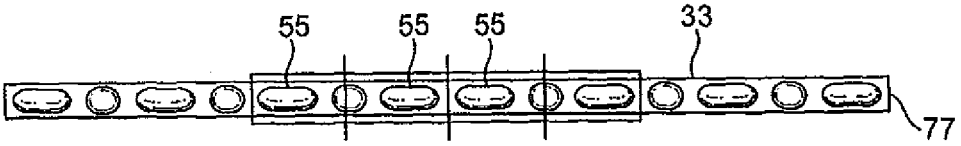
FIG. 2 is a diagrammatic view of a single element strip including sealed receptacles according to a further aspect of the invention.

FIG. 2 shows an elongate first member 33 which is thermoformed from 4.5 mil Clarifoil cellulose acetate sheet. Member 33 includes elongated receptacles 55 which are integrally thermoformed therein, by methods well known in the art. Each elongated receptacle 55 includes 22 cubic mm of fluid (liquid) flavouring agent in the form of flavouring agent (menthol) and propylene glycol in a 70/30 ratio together with a surfactant such as Teepol (to reduce surface tension). The elongate member is coated with an EVA heat seal coating (not shown). The receptacles are hermetically sealed with a capping member 77 formed from Clarifoil 3 mil cellulose acetate sheet, which is bonded to the elongate member by means of the heat seal coating to form sealed frangible "bubbles" including the liquid flavouring agent. The first member 33 is substantially completely covered with capping member 77 which is fixed in register with the first member 33 to cap the receptacles. The member 33 is suitable for use in tobacco smoke filtering elements. It will be appreciated that for use in production of tobacco smoke filters a long strip effectively comprising many members 33 fixed end to end will be formed, and the strip including the filled receptacles will be incorporated into tobacco smoke filters and filter elements by methods known in the art.

In the examples, the term "mil" means one thousandth of an inch.

The invention claimed is:

1. A tobacco smoke filter or filter element comprising: a rod of a tobacco smoke filtering material; and an elongate member including at least one frangible receptacle integrally formed therein as a single element wherein walls and a base of the at least one frangible receptacle are integrally formed with the elongate member and wherein the elongate member and the at least one frangible receptacle formed therein extend longitudinally of the tobacco smoke filter or filter element from one end of the filter or filter element to the other end of the filter or filter element; each one of the at least one frangible receptacle including a fluid and being sealed by a capping member.

2. A tobacco smoke filter or filter element according to claim 1 wherein the at least one receptacle is hermetically sealed by the capping member.

3. A tobacco smoke filter or filter element according to claim 1 wherein the elongate member is substantially completely covered with the capping member applied in register with the elongate member to thereby cap the at least one receptacle.

4. A tobacco smoke filter or filter element according to claim 1 wherein the fluid includes a smoke enhancing additive.

5. A tobacco smoke filter or filter element according to claim 1 wherein the fluid includes a surfactant.

6. A tobacco smoke filter or filter element according to claim 1 wherein the elongate member comprises a plastics material.

7. A tobacco smoke filter or filter element according to claim 1 wherein the elongate member comprises one or more of cellulose acetate, polyethylene (PET), polypropylene, polylactide (PLA) and a collagen.

8. A tobacco smoke filter or filter element according to claim 1 wherein the capping member comprises a plastics material.

9. A tobacco smoke filter or filter element according to claim 1 wherein the capping member comprises one or more of cellulose acetate, polyethylene (PET), polypropylene, polylactide (PLA) and a collagen.

10. A tobacco smoke filter or filter element according to claim 1 wherein the filtering material is of natural or synthetic filamentary tow, natural or synthetic staple fibres, cotton wool, web material, synthetic non-woven material or extruded material.

11. A tobacco smoke filter or filter element according to claim 1 over wrapped with a wrapper.

12. A tobacco smoke filter or filter element according to claim 1 wherein the elongate member and/or the capping member further comprises a pigment.

13. A tobacco smoke filter or filter element according to claim 12 wherein the pigment is of a contrasting colour to the tobacco smoke filtering material.

14. A tobacco smoke filter or filter element according to claim 1 wherein the at least one receptacle which includes fluid has a crush strength of 4 to 30 N.

15. A tobacco smoke filter or filter element according to claim 1 wherein the elongate member and the at least one receptacle formed therein extends longitudinally of the filter or filter element along a central or substantially central longitudinal axis of the rod, or extends longitudinally of the filter or filter element at a periphery of the rod.

16. A tobacco smoke filter or filter element according to claim 4 wherein the smoke enhancing additive comprises a flavoring agent.

* * * * *